US008709233B2

(12) United States Patent
McCoy et al.

(10) Patent No.: US 8,709,233 B2
(45) Date of Patent: Apr. 29, 2014

(54) DISPOSITION OF STEAM CRACKED TAR

(75) Inventors: James N. McCoy, Houston, TX (US); Paul F. Keusenkothen, Houston, TX (US)

(73) Assignee: ExxonMobil Chemical Patents Inc., Houston, TX (US)

( * ) Notice: Subject to any disclaimer, the term of this patent is extended or adjusted under 35 U.S.C. 154(b) by 375 days.

(21) Appl. No.: 11/880,925

(22) Filed: Jul. 25, 2007

(65) Prior Publication Data

US 2008/0116109 A1 May 22, 2008

Related U.S. Application Data

(60) Provisional application No. 60/841,453, filed on Aug. 31, 2006.

(51) Int. Cl.
*C10G 69/06* (2006.01)
*C10C 1/18* (2006.01)

(52) U.S. Cl.
USPC ..... 208/67; 208/39; 208/44; 208/45; 208/68; 208/96

(58) Field of Classification Search
USPC ..... 208/39, 41, 44, 45, 67, 68, 309, 130, 96
See application file for complete search history.

(56) References Cited

U.S. PATENT DOCUMENTS

| | | | |
|---|---|---|---|
| 2,462,593 | A | 2/1949 | Batchelder |
| 2,947,687 | A | 8/1960 | Lee |
| 3,413,211 | A | 11/1968 | Becraft et al. |
| 3,617,493 | A | 11/1971 | Wirth et al. |
| 3,691,058 | A | 9/1972 | Hamner et al. |
| 3,941,681 | A | 3/1976 | Saegusa et al. |
| 3,956,101 | A | 5/1976 | Hara et al. |
| 3,998,726 | A | 12/1976 | Bunas et al. |
| 4,086,156 | A | 4/1978 | Dickakian |
| 4,134,824 | A | 1/1979 | Kamm et al. |
| 4,140,212 | A | 2/1979 | O'Blasny et al. |
| 4,207,168 | A | 6/1980 | Simone |
| 4,219,404 | A | 8/1980 | Dickakian |
| 4,309,271 | A | 1/1982 | Dorner |
| 4,363,715 | A | 12/1982 | Dickakian |
| 4,414,095 | A | 11/1983 | Dickakian |
| 4,431,512 | A | 2/1984 | Dickakian |
| 4,435,274 | A | 3/1984 | Juguin et al. |
| 4,548,704 | A | 10/1985 | Dickakian |
| 4,705,618 | A | 11/1987 | Tsuchitani et al. |

(Continued)

FOREIGN PATENT DOCUMENTS

| | | |
|---|---|---|
| BE | 889974 | 1/1981 |
| CA | 1069846 | 1/1980 |

(Continued)

OTHER PUBLICATIONS

Guthrie, Virgil. Petroleum Products Handbook, First Edition, 1960, p. 6-25.*

(Continued)

*Primary Examiner* — Renee E Robinson

(57) ABSTRACT

In the invention, tar is upgraded by deasphalting and then hydrocracking to produce valuable products such as low sulfur diesel fuel and mogas. The invention is also directed to a system integrating a pyrolysis furnace operation with refinery operations.

14 Claims, 1 Drawing Sheet

(56) References Cited

U.S. PATENT DOCUMENTS

| | | | | |
|---|---|---|---|---|
| 4,721,557 | A * | 1/1988 | Staggs | 208/68 |
| 4,795,551 | A | 1/1989 | Hamilton et al. | |
| 4,816,140 | A | 3/1989 | Trambouze et al. | |
| 5,173,172 | A | 12/1992 | Adams et al. | |
| 5,256,297 | A | 10/1993 | Feimer et al. | |
| 5,358,627 | A | 10/1994 | Mears et al. | |
| 5,489,374 | A | 2/1996 | Romine et al. | |
| 5,785,860 | A | 7/1998 | Smith | |
| 5,871,634 | A | 2/1999 | Wiehe et al. | |
| 6,190,533 | B1 * | 2/2001 | Bradow et al. | 208/57 |
| 6,241,874 | B1 | 6/2001 | Wallace et al. | |
| 2004/0004022 | A1 * | 1/2004 | Stell et al. | 208/106 |
| 2004/0232047 | A1 | 11/2004 | Benazzi et al. | |
| 2006/0016727 | A1 | 1/2006 | Varadaraj | |
| 2006/0272982 | A1 * | 12/2006 | Montanari et al. | 208/86 |
| 2008/0099371 | A1 | 5/2008 | McCoy et al. | |
| 2009/0057200 | A1 | 3/2009 | Leta et al. | |

FOREIGN PATENT DOCUMENTS

| | | |
|---|---|---|
| CA | 2185264 | 5/2000 |
| DE | 3227490 | 7/1987 |
| EP | 0021708 | 1/1981 |
| EP | 0056338 | 7/1982 |
| EP | 0086607 | 8/1983 |
| EP | 0100198 | 2/1984 |
| EP | 0067581 | 11/1985 |
| EP | 0 250 136 | 12/1987 |
| EP | 0243509 | 8/1990 |
| EP | 0791040 | 8/1997 |
| FR | 2510133 | 1/1983 |
| GB | 1032690 | 6/1966 |
| GB | 1 298 098 | 11/1972 |
| GB | 2014605 | 8/1979 |
| GB | 1601644 | 11/1981 |
| GB | 2104544 | 3/1983 |
| JP | 52-81321 | 7/1977 |
| JP | 61-98794 | 5/1986 |
| WO | 93/12200 | 6/1993 |
| WO | 2006/066857 | 6/2006 |

OTHER PUBLICATIONS

Van Dongen et al.; "The Application of Gas/Liquid Cyclones in Oil Refining"; Jan. 1958; Transactions of the ASME; pp. 245-251.

* cited by examiner

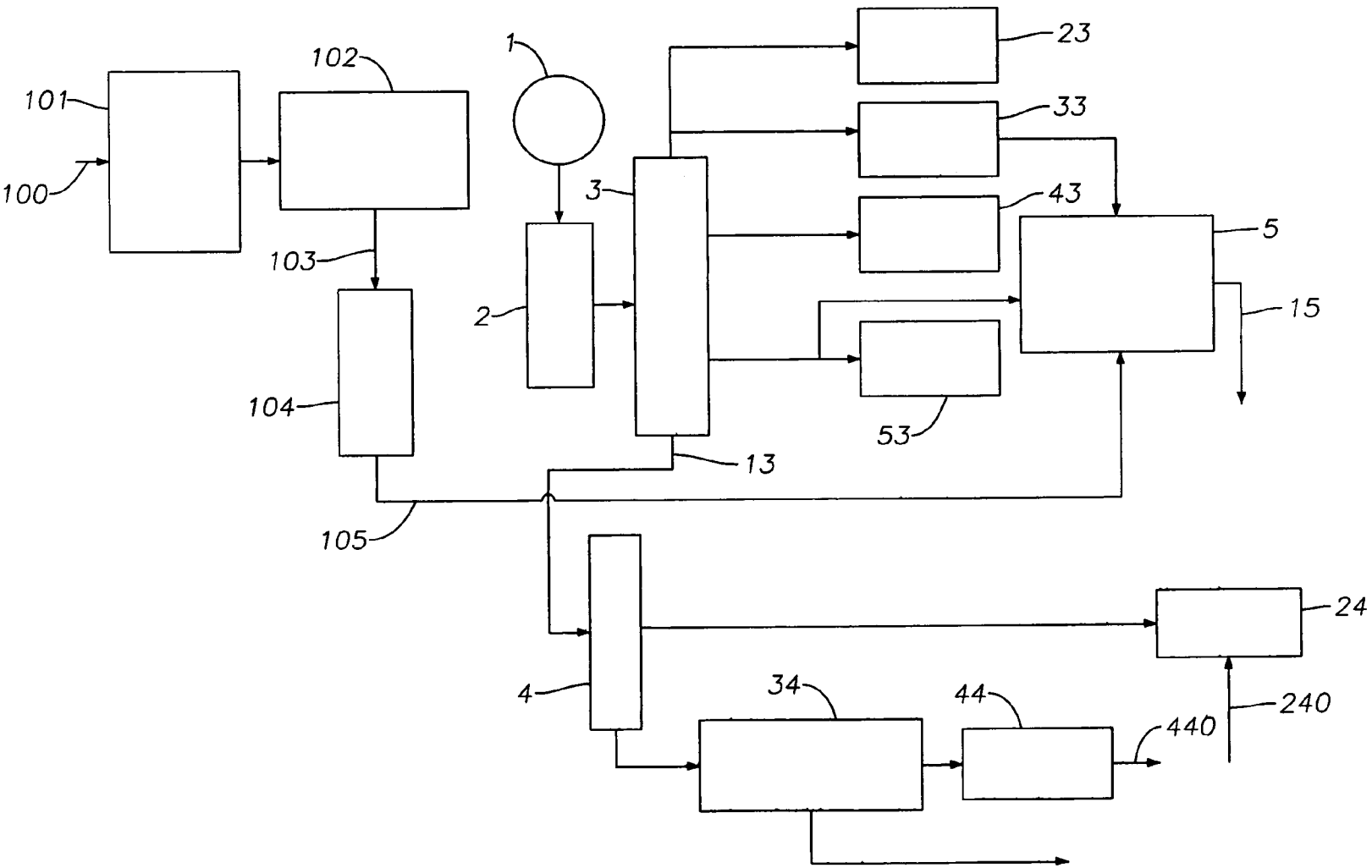
23
33
43
5
15
53
3
13
1
2
102
103
104
105
101
100
24
240
440
44
34
4

DISPOSITION OF STEAM CRACKED TAR

RELATED APPLICATIONS

This application claims benefit of and priority to U.S. provisional patent application Ser. No. 60/841,453, filed Aug. 31, 2006, the entirety of which is incorporated herein by reference.

FIELD OF THE INVENTION

The invention relates to upgrading of tar (pyrolysis fuel oil).

BACKGROUND OF THE INVENTION

Steam cracking, also referred to as pyrolysis, has long been used to crack various hydrocarbon feedstocks into olefins. Conventional steam cracking utilizes a pyrolysis furnace wherein the feedstock, typically comprising crude or a fraction thereof optionally desalted, is heated sufficiently to cause thermal decomposition of the larger molecules. Steam is typically added to the pyrolysis furnace inter alia to reduce hydrocarbon partial pressure, to control residence time, and to minimize coke formation. Among the valuable and desirable products obtained from the furnace include light olefins such as ethylene, propylene, and butylenes. The pyrolysis process, however, also produces molecules that tend to combine to form high molecular weight materials known as steam cracked tar or steam cracker tar ("SCT"), sometimes referred to as pyrolysis fuel oil. Typically tar, as well as steam cracked gas oil ("SCGO") is recovered as bottoms product in the first fractionator after the steam cracker. These are among the least valuable products obtained from the effluent of a pyrolysis furnace. In general, feedstocks containing higher aromatic boiling materials ("heavy feeds") tend to produce greater quantities of SCT.

SCT is among the least desirable of the products of pyrolysis since it finds few uses. SCT tends to be incompatible with other "virgin" (meaning it has not undergone any hydrocarbon conversion process such as FCC or steam cracking) products of the refinery pipestill upstream from the steam cracker. At least one reason for such incompatibility is the presence of asphaltenes. Asphaltenes are very high in molecular weight and precipitate out when blended in even insignificant amounts into other materials, such as fuel oil streams.

The increasing use of lower quality crude feeds to the refinery, i.e., heavier, and more aromatic and/or higher sulfur feeds, has increased the amount of tar produced and, in the case of higher sulfur feeds, increased the difficulty of disposing of it. While tar has always been difficult to dispose of, the tar obtained from these heavy and/or high sulfur feeds is less compatible with refinery fuel oil pools and the typically higher sulfur levels render it unacceptable for burning.

One way to avoid production of SCT is to limit conversion of the pyrolysis feed, but this also reduces the amount of valuable products such as light olefins. Another solution is to "flux" or dilute SCT with stocks that do not contain asphaltenes, but this also requires the use of products that find higher economic value in other uses.

Certain methods of upgrading tar have been proposed in the prior art, but these methods are inefficient and/or do not provide sufficient volume of disposal of low value tar. For instance, U.S. Pat. No. 4,207,168 teaches making needle coke from pyrolysis fuel oil by separating quinoline insolubles and asphaltenes from the fuel oil and subjecting the remaining portion to coking.

GB 2 014 605 treats pyrolysis fuel oil produced during the production of olefins by thermal cracking by first subjecting it to solvent extraction to remove "polymeric compounds". The treated material is said to exhibit "essential differences" from asphaltenes obtained from petroleum fractions (i.e., refinery operations). The polymer-free portion constitutes a material said to be useful as a fuel oil. The polymeric components, precipitated in solid form, are said to be useful in the production of adhesives or in road building.

In the disclosure of U.S. Pat. No. 4,309,271, hydrocarbons are subjected to hydrogenation and, after separation of the product into liquid and gaseous fractions, the liquid fraction is cracked and fractionated. A polymer free fraction of the residue is returned to the feedstock and to the hydrogenation stage, and a heavy residue component of the initial liquid fraction partially oxidized with the residue.

GB 2 104 544 discloses treating pyrolysis tar obtained from the production of ethylene from naphtha feeds via steam cracking by first heating the feedstock with hydrogen to saturate polynuclear aromatic compounds, then hydrocracking the hydrogenated compounds in a cracking zone to obtain an effluent from the cracking zone which may be separated into a gaseous and liquid product.

U.S. Pat. No. 4,548,704 relates to making pitch suitable for spinning into carbon fibers, the pitch being derived from a deasphaltenated middle fraction of a feedstock.

Despite these advances, there remains a problem that SCT continues to be generated in amounts beyond the capacity of current technology to be efficiently utilized. Thus, significant amounts of SCT must be disposed of by adding to fuel oil pools or simply local combustion to generate, for example, steam. However, steam cracker tar, even relatively low asphaltene steam cracker tar, is generally incompatible with fuel oil pools such as Bunker C fuel oil. Onsite tar burning in site boilers is then preferred to avoid tar separation investment, but tighter emission regulations increasingly limit the amount that can be burned for this purpose.

The present inventors have discovered that tar may be upgraded by deasphalting the tar and then sending it to a hydrotreater to produce valuable products such as low sulfur diesel fuel and mogas.

SUMMARY OF THE INVENTION

The invention is directed to a method comprising:

(a) a step of obtaining tar;

(b) at least one step of treating said tar to remove asphaltenes to provide a de-asphalted tar;

(c) at least one step of hydrotreating said deasphalted tar to obtain a product comprising hydrotreated, deasphalted tar; and optionally (d) isolating/recovering from said hydrotreated, deasphalted tar product at least one product selected from mogas, distillate (diesel) and hydrocrackate (bottoms).

The invention is also directed to a method of treating tar by deasphalting said tar and treating the product, by hydrotreating to obtain hydrotreated, deasphalted tar products including as low sulfur mogas, distillate (diesel), and hydrotreater bottoms (hydrocrackate). The hydrocrackate may be advantageously blended with Bunker Fuel.

In a preferred embodiment, the invention relates to a method comprising: obtaining tar; treating the tar to remove asphaltenes to provide a de-asphalted tar; hydrotreating the deasphalted tar; and isolating at least hydrotreated, deasphalted tar product.

In a preferred embodiment at least a portion of the hydrotreating occurs in a high pressure hydrocracker.

The invention is also directed to a system for the upgrading of tar comprising, in series, a pyrolysis furnace, a primary fractionator whereby tar is obtained as a bottoms product, a deasphalter whereby tar is deasphalted, and a hydrocracker, particularly wherein said hydrocracker is integrated with at least one refinery pipestill.

It is an object of the invention to upgrade tar to provide a hydrotreated, deasphalted tar products having end uses such as low sulfur diesel fuel, mogas, and fuel oil.

It is also an object of the invention to provide an integrated system combining a chemical plant process with a refinery process, in particular to more efficiently use a hydrotreater to improve the yield of higher end products such as distillate, hydrotreater bottoms and mogas.

These and other objects, features, and advantages will become apparent as reference is made to the following detailed description, preferred embodiments, examples, and appended claims.

BRIEF DESCRIPTION OF THE DRAWINGS

FIG. 1 is a process flow diagram illustrating a preferred embodiment of the present invention.

DETAILED DESCRIPTION

According to the invention, tar is treated to remove asphaltenes to provide a de-asphalted tar. The de-asphalted tar is then hydrotreated to produce a product comprising a hydrotreated deasphalted tar product which may be fractionated to obtain at least one product selected from the group consisting of low sulfur mogas, distillate (diesel), and hydrotreater bottoms (hydrocrackate). When integrated with a refinery hydrotreater the yield of such high value products as distillate, hydrocrackate, and mogas may be improved. The hydrotreated bottoms product has a viscosity and sulfur credit versus Bunker Fuel and is advantageously blended therewith.

Crude, as used herein, means whole crude oil as it issues from a wellhead, optionally including a step of desalting and/or other steps as may be necessary to render it acceptable for conventional distillation in a refinery. Crude as used herein is presumed to contain resid unless otherwise specified.

The terms thermal pyrolysis unit, pyrolysis unit, steam cracker and steamcracker are used synonymously herein; all refer to what is conventionally known as a steam cracker, even though steam is optional.

"Tar" or steam cracker tar (SCT) as used herein is also referred to in the art as "pyrolysis fuel oil". The terms will be used interchangeably herein. The tar will typically be obtained from the first fractionator downstream from a steam cracker (pyrolysis furnace) as the bottoms product of the fractionator, nominally having a boiling point of 550° F.+ (288° C.+) and higher.

In a preferred embodiment, SCT is obtained as a product of a pyrolysis furnace wherein additional products include a vapor phase including ethylene, propylene, butenes, and a liquid phase comprising C5+ species, having a liquid product distilled in a primary fractionation step to yield an overheads comprising steam-cracked naphtha fraction (e.g., C5-C10 species) and steam cracked gas oil (SCGO) fraction (i.e., a boiling range of about 400° F. to 550° F., e.g., C10-C15/C17 species), and a bottoms fraction comprising SCT and having a boiling range above about 550° F., e.g., C15/C17+ species).

The term "asphaltene" as used herein means a material obtainable from crude oil and having an initial boiling point above 1200° F. (650° C.) and which is insoluble in a paraffinic solvent.

The tar may be deasphalted by methods known per se in the art, such as by use of fractionation, membrane technology or by solvent deasphalting, to remove asphaltenes and/or fractions boiling above about 1050° F. (about 566° C.).

A fractionation step may be employed to remove asphaltenes, such as by use of distillation, flash drum or other vapor/liquid separation device, or combination thereof. Preferred vapor/liquid separation devices described in US Applications 2004/0004022; 2004/0004027; 2004/0004028; 2005/0209495; 2005/0261530; 2005/0261531; 2005/0261532; 2005/0261533; 2005/0261534; 2005/0261535; 2005/0261536; 2005/0261537; and 2005/0261538. Another preferred vapor/liquid separation device is described in U.S. Pat. No. 6,632,351. In a preferred embodiment using a vapor/liquid separation device, the composition of the vapor phase leaving the device is substantially the same as the composition of the vapor phase entering the device, and likewise the composition of the liquid phase leaving the flash drum is substantially the same as the composition of the liquid phase entering the device, i.e., the separation in the vapor/liquid separation device consists essentially of a physical separation of the two phases entering the drum.

Still another preferred fractionation apparatus is described in copending, commonly assigned, U.S. Provisional Application Ser. No. 60/841,597, filed Aug. 31, 2006, utilizing a vacuum pipestill (VPS) including a flash zone separated from a zone comprising trays by at least one annular ring or entrainment device and obtaining as an overheads a deasphalted tar product, which is sent to the hydrotreater according to the present invention, and as a bottoms an asphaltenic heavy tar product, which may be blended with fuel oil. The annular ring defines a ceiling which blocks upward passage of vapor/liquid mixtures along the circular wall beyond the ceiling section, and surrounds an open core having sufficient cross-sectional area to permit vapor velocity low enough to avoid significant entrainment of liquid. The use of an annular entrainment device in a distillation tower has been described per se in U.S. Pat. No. 4,140,212 and also U.S. Application Publication Nos. 2004/0004028; 2005/0261530; 2006/0089519; WO 2004/005431; and WO 2005/113715, and by Van Dongen and Ter Linden for oil refining in Transactions of the ASME, January 1958, pp. 245-251. Any of the annular entrainment devices discussed in these references may be used as an annular entrainment device in the VPS used to deasphalt tar and provide the deasphalted tar according to the present invention.

Membranes useful for separating asphaltenes out of the tar are preferably those membranes made out of materials that can run hot enough to let the resid or tar be deasphalted in the liquid phase at relatively low flux. Especially preferred membranes are ceramic membranes.

Solvent deasphalting is a per se known process whereby asphaltenes are removed from a substance by solvent extraction. The solvent used is typically a low-boiling non-polar hydrocarbon as an extraction agent to remove compounds which do not dissolve in the solvent. Preferred solvents include propane, butanes, propanes, hexanes, and mixtures thereof. Solvent extraction using toluene, which does not remove significant amounts of asphaltenes, may also be used in addition to the solvent extraction using the low-boiling, non-polar hydrocarbons described.

The deasphalted tar product, which is obtained in the solvent-soluble fraction in the case of solvent deasphalting, or as overheads in the case of fractionation, or as the passed-through material in the case of membrane separation, is then sent to a hydrotreater to be hydrotreated.

The term "hydrotreating" as used herein includes at least one of hydrodesulfurization (DHS), hydrodenitrogention (HDN), hydrodeoxygenation (HDO), hydrofining, and hydrocracking. The terms are well-known to one of ordinary skill in the art.

The hydrotreatment may be of the type per se known in the art. While a hydrotreating step comprised of any one or combination of the aforementioned hydrotreatments, it is preferred that the hydrotreatment include hydrocracking. In a preferred embodiment, the deasphalted tar product is be thermally or catalytically hydrocracked at conditions of about 600° F. to 800° F. (316-427° C.) and about 34 to 207 barg (500-3000 psig) hydrogen partial pressure (temperatures and pressures measured at the reactor outlet). The hydrotreating (e.g. hydrocracking) step may use a catalyst, such as cobalt molybdenum or nickel molybdenum, which may be supported such as by alumina or unsupported, and in a preferred embodiment a space velocity of from about 3 to 7 gm/hr/mg catalyst.

In a more preferred embodiment, the hydrocracking is conducted at severe conditions, such as about 650° F. to 800° F. (343-427° C.), more preferably about 700° F. to 800° F., at about 1500-3000 psig, more preferably about 2000 to 3000 psig, at <3 gm/hr/mg catalyst space velocity, such as about 1 to 2.5 gm/hr/mg catalyst (conditions at reactor outlet).

In a preferred embodiment, there is no step of hydrogenation between the primary fractionator downstream of the pyrolysis furnace and the hydrotreating (e.g. hydrocracking) step.

The hydrotreating may be carried out utilizing a single zone or a plurality of zones, e.g., two or more hydrotreating zones in parallel or in series. For example, in one embodiment a first zone with a first catalyst can be designed to accumulate most of the metals removed from the feedstock, and in series a second zone with a second catalyst can be designed for maximum heteroatom removal and aromatics hydrogenation. In another embodiment, a first catalyst can be designed to accumulate most of the metals removed from the feedstock, and a second zone with a second catalyst can be designed for maximum heteroatom removal and a third zone with a third catalyst can be designed to increase aromatics hydrogenation. The first and second catalysts may be piped in series reactors or loaded in series in the same zone. Design specifics as it relates to the hydrotreater(s) per se do not form a critical part of this invention.

Surprisingly, the present invention achieves, as a product of the hydrocracker, products which are upgraded from fuel oil and which in preferred embodiments comprise, as side-streams or overheads of the hydrotreater fractionator, mogas blendstock and diesel (distillate), and a bottoms product of the hydrotreater fractionator compatible in all proportions with fuel oil and which in preferred embodiments has a viscosity and sulfur credit versus Bunker Fuel.

EXAMPLE

The following example is meant to illustrate the present invention and not limit it. Numerous modifications and variations are possible and it is to be understood that within the scope of the appended claims, the invention may be practiced otherwise than as specifically described herein.

Referring to FIG. 1, crude oil 1 is desalted in desalting apparatus 2 of a type well-known in the art and supplied an atmospheric pipestill (APS) 3 wherein it is separated into a plurality of streams, such as a portion boiling below 320° F. which may be sent to a naphtha hydrofiner 23 and natural gas which may be sent to a hydrogen plant 33 to supply hydrogen to the hydrotreater 5 downstream of the APS, a cut having a boiling point range of about 320° F. to about 450° F. sent to hydrofiner 43 to produce jet fuel and/or kerosene, and a cut having a boiling point between about 450° F. and 580° F., a portion of which may be sent to the hydrotreater 5 and a portion of which may be sent to the distillate hydrofiner 53.

Various products may be derived from hydrotreater 5 by, for instance, separation in a fractionator downstream of the hydrotreater, such as distillate (diesel), mogas, and hydrotreater bottoms (e.g. hydrocrackate), among others, collectively illustrated by product line 15.

The atmospheric residuum stream which is recovered from the bottom of APS 3 via line 13 to a vacuum pipestill (VPS) 4 operated under sub atmospheric pressure, such as 2 psia. The atmospheric residuum may be separated in VPS 4 into a plurality of streams such as a gas oil stream, a vacuum residuum stream, and other streams, such as a cut from about 880° F. to 1050° F. sent to a gofiner/residfiner 24, which may optionally also be integrated with a stream of coker gas oil 240 as illustrated in the figure.

The vacuum residuum stream (1050° F.+) is removed from the bottom of the VPS 4 and sent to coker/deasphalter 34, producing a bottoms product of coke/asphalt and a product which is sent to a fractionator 44 and then to further processing through line 440. For instance, the fractionator will typically produce coker naphtha, coker gas oil, and fractionator bottoms, all of which may go to the hydrotreater with the deasphalted tar or be sent to different dispositions such as other hydrofining.

The devices thus far discussed in FIG. 1, i.e., desalter, APS, various hydrofiners, hydrogen plant, hydrotreater, VPS, coker/deasphalting, gofiner/residfiner, fractionator, are per se well known in the art and represent, collectively, refinery operations. Numerous variations are known in the art and they do not represent, divorced from the chemical operations of olefins manufacture by use of the pyrolysis furnace, part of the present invention. However, as part of the present invention, these refinery operations may be integrated with the present invention as illustrated in FIG. 1. Without wishing to be bound by theory, the present inventors believe that one of the advantages of the present invention is the integration of refinery operations with a novel process whereby tar obtained from chemical steam cracking apparatus is upgraded.

Continuing with the description of FIG. 1, feed 100, which may be crude (such as a high sulfur containing virgin crude rich in polycyclic aromatics which has been desalted), or a crude fraction thereof (such as may be obtained in an APS of the type used for device 3 or VPS of the type used for device 4), optionally and preferably desalted, is provided to pyrolysis furnace 101. Furnace 101 may be a typical pyrolysis furnace such as known per se in the art. While the operating conditions of such a furnace are not per se a part of the present invention, typical conditions will include a radiant outlet temperature of between 760° C.-880° C., a cracking residence time period of 0.01 to 1 sec, and a steam dilution of 0.2 to 4.0 kg steam per kg hydrocarbon.

It is preferably a furnace of the type having a vapor/liquid separation device (sometimes referred to as flash pot or flash drum) integrated therewith, such as disclosed and described in the patent applications set forth above with respect to the disclosure of the preferred vapor/liquid separation device. In this embodiment, a feedstream is provided to the inlet of a convection section of a pyrolysis unit, wherein it is heated so that at least a portion of the feedstream is in the vapor phase. Steam is optionally but preferably added in this section and mixed with the feedstream. The heated feedstream with optional steam and comprising a vapor phase and a liquid phase is then flashed in a vapor/liquid separation device to drop out the heaviest fraction (e.g., asphaltenes). In still more preferred embodiments the vapor/liquid separation device integrated with the pyrolysis furnace operates at a temperature of from about 800° F. (about 425° C.) to about 850° F. (about 455° C.). The overhead from this device are then introduced via crossover piping into the radiant section where it is quickly heated, such as at pressures ranging from about 10 to 30 psig, to a severe hydrocarbon cracking temperature, such as in the range of from about 1450° F. to 1550° F., to provide cracking of the feedstream. One of the advantages of having a vapor/liquid separation device downstream of the convection section inlet and upstream of the crossover piping to the radiant section is that it increases the feedstreams available to be used directly, without pretreatment, as feed to a pyrolysis furnace. Thus, crude oil, even high naphthenic acid containing crude oil and fractions thereof, may be used directly as feed. Feeds having a high naphthenic acid content are among those that produce a high quantity of tar and are especially suited to be advantageously used as feed to the pyrolysis furnace according to the process of the present invention.

Continuing in the description of FIG. 1, the feed 100 is converted in the pyrolysis furnace 101 at an elevated temperature to cracked products. The hot cracked gas may be quenched or passed at substantially the elevated temperature of the furnace into a pyrolysis fractionating column or primary fractionator 102. Within the fractionating column 102, the cracked products are separated into a plurality of fractionation streams including $H_2$, methane, higher alkanes, and olefins such as ethylene, propylene, butenes, which are recovered from the fractionating column 102 via respective conduits (not shown) along with a bottoms product comprising tar and steam cracked gas oil (SCGO) which is sent via line 103 to the asphaltene removal stage represented by device 104, which may comprise one or more of membrane separation, solvent deasphalting, and fractionation, as described in more detail above. As shown in FIG. 1 and in accordance with the present invention, the optionally deasphalted tar/SCGO (the residue comprising material boiling about 400° F. to 1200° F., the 1200° F.+ material being substantially removed in the deasphalting step) is sent via line 105 to the hydrotreater 5 where the material is hydrocracked, preferably under severe conditions, as described above, which favor complete saturation. Preferred products from the hydrotreater 5 include at least one of low sulfur mogas, distillate (diesel) and hydrotreater bottoms compatible with fuel oil.

Preferred feeds to the pyrolysis furnace will include crude oil and fractions thereof. These may be optionally desalted and/or optionally obtained from a refinery pipestill. Preferred feeds include gas oil, vacuum gas oil, crude oil, crude oil residues. It is especially preferred that when the feed comprises greater than about 0.1 wt %, or preferably greater than about 5.0 wt % asphaltenes, a vapor liquid separation device, which may optionally be integrated with the pyrolysis furnace, is advantageously used to remove at least a portion of asphaltenes in the feed prior to entering the radiant section of the pyrolysis unit, such as described in U.S. Patent Application Nos. 2004/0004022; 2004/0004027; 2004/0004028; 2005/0209495; 2005/0261530; 2005/0261531; 2005/0261532; 2005/0261533; 2005/0261534; 2005/0261535; 2005/0261536; 2005/0261537; and 2005/0261538. In this preferred vapor liquid separation device integrated with a pyrolysis furnace or "integrated vapor liquid separation device", feedstock is provided to the convection section of the pyrolysis furnace, whereby at least a portion of the feedstock is vaporized, followed subsequently by passing the at least partially vaporized feedstock, optionally with steam, to a flash drum, wherein a vapor phase and liquid phase are separated. The vapor phase is fed to the radiant section of a pyrolysis furnace, and products, including desirable light olefins, are obtained as effluent of the furnace. Preferred feeds to the pyrolysis furnace have up to about 5 wt % sulfur in the feed. The present invention is also advantageously applied to the case where the feed to the pyrolysis furnace comprises high amounts of aromatic sulfur, most of which ends up in the steam cracker tar product (typically at sulfur concentrations about 3 to 4 times higher in the tar than in the feed, by weight) which is deasphalted and then hydrotreated as described herein. In the process according to the present invention, the preferred and advantageous disposition of deasphalted tar is to mogas and/or distillate (diesel), each of which has a value considerably above Bunker Fuel, and hydrotreated bottoms having a viscosity and sulfur credit versus Bunker Fuel.

Trade names used herein are indicated by a ™ symbol or ® symbol, indicating that the names may be protected by certain trademark rights, e.g., they may be registered trademarks in various jurisdictions.

All patents and patent applications, test procedures (such as ASTM methods, UL methods, and the like), and other documents cited herein are fully incorporated by reference to the extent such disclosure is not inconsistent with this invention and for all jurisdictions in which such incorporation is permitted.

When numerical lower limits and numerical upper limits are listed herein, ranges from any lower limit to any upper limit are contemplated. While the illustrative embodiments of the invention have been described with particularity, it will be understood that various other modifications will be apparent to and can be readily made by those skilled in the art without departing from the spirit and scope of the invention.

The invention has been described above with reference to numerous embodiments and specific examples. Many variations will suggest themselves to those skilled in this art in light of the above detailed description. All such obvious variations are within the full intended scope of the appended claims, including, by way of preferred examples which are not intended to be limiting, a method comprising: (a) a step of obtaining tar; (b) at least one step of treating said tar to remove asphaltenes to provide a de-asphalted tar; (c) at least one step of hydrotreating said deasphalted tar to obtain a product comprising a hydrotreated deasphalted tar; optionally (d) isolating/recovering said hydrotreated, deasphalted tar product, such as by fractionating downstream of the hydrotreater; and still more preferred embodiments including at least one of the following: wherein said hydrotreated, deasphalted tar product is selected from low sulfur mogas, distillate (diesel) and hydrotreater bottoms, and mixtures thereof; wherein (a) includes fractionating the effluent of a pyrolysis furnace, and isolating a bottoms product comprising tar from said fractionating; wherein step (a) further includes providing a feed comprising crude oil or fraction thereof to said pyrolysis furnace and cracking said feed to produce said effluent, particularly wherein said feed is selected from the group consisting of whole crude optionally desalted, gas oil, atmospheric resid and/or wherein said feed pass through a vapor/liquid separation device integrated with the convection section of said pyrolysis furnace; wherein said hydrotreating comprises hydrocracking and there is no other hydrogenation step between step (a) and step (d); wherein step (c) comprises hydrocracking optionally in the presence of a hydrocracking catalyst, particularly wherein said hydrocracking includes reactor conditions of from about 316° C. to 427° C., from about 500 to 3000 psig hydrogen partial pressure, and a space velocity of from about 3 to 7 gm/hr/mg catalyst; wherein step (c) comprises hydrotreating under conditions including a reactor temperature of from about 343° C. to 427° C. with pressure of from about 1500 to 3000 psig hydrogen partial pressure, and a space velocity of less than <3 gm/hr/mg catalyst; wherein step (b) is at least one method selected from solvent deasphalting, fractionation, and membrane separation; wherein the process further comprises fractionating the product of step (d) to produce a product suitable for and compatible in all proportions with at least one fuel selected from the group consisting of diesel fuel, mogas, and refinery fuel oil pools; wherein step (b) includes separation by at least one ceramic membrane. Another preferred embodiment is a system for the upgrading of tar comprising, in series, a pyrolysis furnace fluidly connected to a primary fractionator whereby tar is obtained as a bottoms product, said primary fractionator fluidly connected to a deasphalter whereby tar is deasphalted, said deasphalter fluidly connect to a hydrocracker; and also a still more preferred embodiment wherein said hydrocracker is integrated with at least one refinery pipestill, especially wherein said hydrocracker is integrated with refinery process including fluid connection with a refinery atmospheric pipestill hydrogen plant to provide a stream of hydrogen to said hydrocracker, and fluid connection with a refinery vacuum pipestill to provide a stream of deasphalted vacuum resid.

What is claimed is:

1. A method comprising:

(a) a step of obtaining steam cracked tar, wherein (a) includes fractionating the effluent of a pyrolysis furnace to provide a bottoms product comprising steam cracked tar and to provide one or more products comprising light olefins selected from ethylene, propylene, and butenes, are separated in a primary fractionator, and isolating a bottoms product comprising tar from said fractionating;

(b) at least one step of treating said steam cracked tar via solvent deasphalting to remove asphaltenes to provide a deasphalted tar; and (c) at least one step of hydrotreating said deasphalted tar to obtain a hydrotreated, deasphalted tar product;

(d) separating a hydrocrackate from said hydrotreated, deasphalted tar product by fractionation, wherein (i) said hydrocrackate is obtained as bottoms product and (ii) said hydrocrackate is characterized as providing a viscosity and sulfur credit versus Bunker C Fuel; and (e) blending said hydrocrackate with Bunker Fuel to produce a compatible blend.

2. The method of claim 1, wherein step (a) further includes providing a feed comprising crude oil or fraction thereof to said pyrolysis furnace and cracking said feed to produce said effluent.

3. The method of claim 2, wherein said feed is selected from the group consisting of whole crude optionally desalted, gas oil, atmospheric resid, and mixtures thereof.

4. The method of claim 2, wherein said feed passes through a vapor/liquid separation device integrated with the convection section of said pyrolysis furnace.

5. The method of claim 1, wherein said hydrotreating comprises hydrocracking and wherein said process is further characterized as having no other hydrogenation step between step (a) and step (d).

6. The method of claim 1, wherein step (c) comprises hydrocracking, optionally in the presence of a hydrocracking catalyst.

7. The method of claim 6, wherein said hydrocracking includes reactor conditions of from about 316° C. to 427° C., from about 500 to 3000 psig hydrogen partial pressure, and a space velocity of from about 3 to 7 gm/hr/mg catalyst.

8. The method of claim 1, wherein step (c) comprises hydrotreating under conditions including a reactor temperature of from about 343° C. to 427° C. with pressure of from about 1500 to 3000 psig hydrogen partial pressure, and a space velocity of less than <3 gm/hr/mg catalyst.

9. The method of claim 1, wherein step (b) further comprises membrane separation.

10. The method of claim 9, wherein step (b) includes separation by at least one ceramic membrane.

11. The method of claim 1, further comprising fractionating the product of step (d) to produce a product suitable for and compatible in all proportions with at least one fuel selected from the group consisting of diesel fuel, mogas, and refinery fuel oil pools.

12. The method of claim 1, wherein said effluent is from said pyrolysis furnace having a radiant outlet temperature between 760° C. to 880° C.

13. A process comprising a step of steam cracking of a feedstock to provide a first product comprising light olefins selected from ethylene, propylene, and butenes, and steam cracked tar, a step of deasphalting said steam cracked tar via solvent deasphalting to provide a deasphalted tar, a step of hydrotreating said deasphalted tar to provide a hydrotreated deasphalted tar, a step of fractionating said hydrotreated deasphalted tar to provide a hydrotreated bottoms product, and a step of blending said hydrotreated bottoms product with Bunker Fuel to produce a compatible blend; and wherein (i) the first product and the steam cracked tar are separated in a primary fractionator; (ii) said hydrotreated bottoms product has a viscosity and sulfur credit versus Bunker C Fuel; and (iii) said hydrotreating is selected from the group consisting of hydrodesulfurization, hydrodenitrogention, hydrodeoxygenation, hydrofining, and combinations thereof.

14. The process of claim 13, wherein said process is carried out in a system comprising, fluidly connected in series, a pyrolysis furnace, said primary fractionator suitable for providing tar as a bottoms product, a deasphalter suitable for deasphalting steam cracked tar, and at least one hydrotreater, preferably including a hydrocracker, suitable for hydrotreating deasphalted tar, and optionally a fractionator downstream of said hydrotreater.

* * * * *